US007726030B2

(12) United States Patent
Hayes

(10) Patent No.: US 7,726,030 B2
(45) Date of Patent: Jun. 1, 2010

(54) DOUBLE HANDLE KITCHEN KNIFE

(76) Inventor: Brian William Hayes, 840 Shore Rd. Apt 4E, Long Beach, NY (US) 11561

( * ) Notice: Subject to any disclaimer, the term of this patent is extended or adjusted under 35 U.S.C. 154(b) by 0 days.

(21) Appl. No.: 11/949,782

(22) Filed: Dec. 4, 2007

(65) Prior Publication Data

US 2009/0139097 A1 Jun. 4, 2009

(51) Int. Cl.
*B26B 3/00* (2006.01)

(52) U.S. Cl. ..... 30/312; 30/296.1; 30/340

(58) Field of Classification Search ..... 30/123, 30/142, 147–149, 233, 235, 241, 228, 272.1, 30/277.4, 295, 329, 340, 342, 337, 320, 392, 30/296.1, 298, 312, 299–307; D7/646, 649, D7/650, 381, 385, 401.2; D8/98, DIG. 1, D8/DIG. 4, 107; 452/161, 164, 132, 132.6; 16/110.1, 111.1, 431, 900, 445, 442, 430
See application file for complete search history.

(56) References Cited

U.S. PATENT DOCUMENTS

| | | | | | |
|---|---|---|---|---|---|
| 25,818 | A | * | 10/1859 | Goodall | 30/298 |
| 108,141 | A | * | 10/1870 | Houseman et al. | 30/295 |
| 165,841 | A | * | 7/1875 | Kellogg | 30/312 |
| 173,955 | A | * | 2/1876 | Hudson | 30/320 |
| 226,146 | A | * | 3/1880 | Zimmerer | 30/299 |
| 230,393 | A | * | 7/1880 | Barker et al. | 30/340 |
| 235,425 | A | * | 12/1880 | Gearon | 30/312 |
| 296,304 | A | * | 4/1884 | Allen | 30/312 |
| 331,915 | A | * | 12/1885 | Smith | 30/312 |
| 369,314 | A | * | 9/1887 | Brougher | 7/158 |
| 391,268 | A | * | 10/1888 | Parker | 30/123 |
| 431,584 | A | * | 7/1890 | Holland | 30/155 |
| 492,409 | A | * | 2/1893 | May | 30/295 |
| D22,439 | S | * | 5/1893 | McGuigan | D7/649 |
| 538,459 | A | * | 4/1895 | McCausland | 30/307 |
| 605,577 | A | * | 6/1898 | Hutchinson | 30/521 |
| 649,059 | A | * | 5/1900 | Kern | 30/295 |
| 673,506 | A | * | 5/1901 | Pitts | 30/295 |
| 682,624 | A | * | 9/1901 | Klickman | 30/295 |
| 682,938 | A | * | 9/1901 | Ingram | 30/295 |
| 696,050 | A | * | 3/1902 | Iwan | 30/321 |
| 725,811 | A | * | 4/1903 | Asbell | 30/123 |

(Continued)

FOREIGN PATENT DOCUMENTS

EP 162995 A1 * 12/1985

(Continued)

OTHER PUBLICATIONS

PCT/US08/83372, Hayes.

*Primary Examiner*—Jason Daniel Prone

(57) ABSTRACT

Double handle knives and attachments to convert a knife to a double handle knife are described with secondary handles able to form an angle of 45 degrees (+ or −15) degrees between the long axis of the secondary handle and the long axis of the blade in a plane at about right angles to the plane of the blade. Embodiments describe fixed and rotatable means of attachment of the secondary handle to the blade. Embodiments further describe reversible and permanent means of attachment of the secondary handle. The placement of the secondary handle at the angle described allows for the optimal positioning of the hands for both controlling an assisting with the cutting of foods and other items.

11 Claims, 9 Drawing Sheets

U.S. PATENT DOCUMENTS 797,461 A * 8/1905 Schultz ..... 30/298
898,574 A * 9/1908 Gotchall ..... 30/340
907,345 A * 12/1908 Halfmann ..... 30/298
983,736 A * 2/1911 Maconochie ..... 30/295
986,166 A 3/1911 Hass
1,008,088 A * 11/1911 Swineford ..... 30/312
1,082,363 A * 12/1913 Slusser ..... 30/272.1
1,118,507 A * 11/1914 Meyer ..... 30/285
1,178,363 A * 4/1916 Waring ..... 30/304
1,222,366 A * 4/1917 Curry ..... 30/286
1,294,609 A * 2/1919 Boone ..... 30/299
1,333,960 A * 3/1920 Brehm ..... 30/285
1,491,623 A * 4/1924 Pitchur ..... 30/295
1,504,501 A * 8/1924 Pope ..... 30/312
1,505,444 A * 8/1924 Swanson ..... 30/295
1,530,796 A * 3/1925 Thomsen ..... 30/304
1,589,156 A * 6/1926 Hartman ..... 30/312
1,687,403 A * 10/1928 Stafford ..... 30/299
1,706,918 A 3/1929 Erikson
1,750,577 A * 3/1930 De Bracht ..... 30/295
1,755,351 A * 4/1930 Felardo ..... 30/295
1,863,153 A * 6/1932 Christopherson ..... 30/293
1,935,149 A * 11/1933 Elvin ..... 452/132
2,217,100 A * 10/1940 Burns ..... 30/295
D131,152 S * 1/1942 Jacobs ..... D7/643
D131,224 S * 1/1942 Parisi ..... D7/401.2
2,560,271 A * 7/1951 Block ..... 30/114
2,582,988 A * 1/1952 Harvey ..... 30/295
2,590,709 A * 3/1952 Kahn ..... 30/295
2,650,424 A * 9/1953 Kalmon ..... 30/295
2,737,719 A * 3/1956 Ember et al. ..... D7/650
2,739,498 A * 3/1956 Champlin, Jr. ..... 30/308
2,748,477 A * 6/1956 Smith ..... 30/231
2,776,680 A * 1/1957 Waddell ..... 30/392
2,782,787 A * 2/1957 Cary ..... 30/298
D183,290 S * 7/1958 Shock ..... D8/DIG. 1
3,593,419 A * 7/1971 Hula ..... D7/650
4,028,806 A * 6/1977 Sheldon ..... 30/296.1
4,054,994 A * 10/1977 Grossman ..... 30/296.1
4,095,337 A * 6/1978 Pharr ..... 30/158
D255,974 S * 7/1980 Jacoby ..... D7/401.2
4,247,984 A * 2/1981 McArdle et al. ..... 30/296.1
4,601,102 A * 7/1986 Phillips ..... 452/132
4,716,653 A * 1/1988 Skyba ..... 30/296.1
4,967,476 A * 11/1990 Mozeliak ..... 30/312
4,980,977 A * 1/1991 Matin et al. ..... 30/295
5,113,587 A * 5/1992 Loomis ..... 30/340
D391,115 S * 2/1998 Roberton ..... D7/401.2
5,784,787 A * 7/1998 Jensen ..... 30/315
D397,282 S * 8/1998 Derkatz ..... D8/107
5,920,992 A 7/1999 Watermolen et al.
D445,643 S * 7/2001 Kazaklaris ..... D7/401.2
6,254,293 B1 * 7/2001 Citrenbaum ..... 30/340
6,381,855 B1 * 5/2002 Lin ..... 30/295
D461,681 S * 8/2002 Lothe ..... D7/401.2
D461,688 S * 8/2002 Lothe ..... D7/649
6,493,946 B1 12/2002 Carillo
D538,591 S * 3/2007 Aston, III ..... D7/401.2
D539,085 S * 3/2007 Aston, III ..... D7/401.2
D539,086 S * 3/2007 Aston, III ..... D7/401.2
2002/0170184 A1 * 11/2002 Lothe ..... 30/295
2004/0010923 A1 * 1/2004 Guiver et al. ..... 30/296.1
2005/0097759 A1 * 5/2005 Igarashi ..... 30/277.4
2009/0139096 A1 * 6/2009 Hayes ..... 30/298
2009/0139097 A1 * 6/2009 Hayes ..... 30/296.1
2009/0139098 A1 * 6/2009 Hayes ..... 30/312
2009/0142463 A1 * 6/2009 Hayes ..... 30/298
2009/0151172 A1 * 6/2009 Hayes ..... 30/295
2009/0229132 A1 * 9/2009 Hayes ..... 30/295

FOREIGN PATENT DOCUMENTS

FR 2600574 A1 * 12/1987
JP 2002/045581 2/2002

* cited by examiner

DOUBLE HANDLE KITCHEN KNIFE

CROSS-REFERENCES TO RELATED APPLICATIONS

This application relates to disclosure in U.S. Disclosure Document No. 604437, filed on Aug. 9, 2006, that is entitled "Swivel Post Cutting Knife".

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

1. Field of Invention

This invention refers to double handle kitchen knives and handle attachments to convert a knife into a double handle knife, specifically to improvements in the positioning of the secondary handle which allow for greater ease and accuracy in the cutting of food items and other objects.

2. Background of Invention

The vast majority of kitchen knives in use today employ conventional handles extending off the back end of a blade whereas the front of the blade comes to a point. These knives allow a user to grip the knife with their dominant hand leaving their non-dominant hand free to control the food item or other object being cut. This arrangement allows precise cutting of the food item but has the disadvantage that the dominant hand is doing most of the work. This often leads to hand and wrist fatigue especially for the elderly, people predisposed to wrist injury, and others who prepare a lot of difficult to cut foods such as carrots, squash, pumpkins, potatoes, frozen foods, and so forth. To help alleviate this, people sometimes use their non-dominant hand to assist their dominant hand in cutting through a food item. This may be done by positioning the food item with the palm and thumb of the non-dominant hand while simultaneously using the index and middle fingers of the same to press down on the top front of a blade pinning it to a cutting surface, gripping the handle with the dominant hand and raising it to clear the food item, then levering down cutting through it with the assistance of the non-dominant hand. However, pressing down on the top of the thin knife blade with the fingers can be very uncomfortable and limits the downward force that is possible.

Double handle knives in addition to a primary handle used by the dominant hand provide a secondary handle for use by the non-dominant hand so that both hands can comfortably apply downward pressure on broad handles. Using the four available fingers (thumb excluded) of the non-dominant hand to press down evenly on the secondary handle would provide maximum benefit and minimize hand and wrist fatigue. However none of the prior art double handle knives provide secondary handles designed for the dual purpose of allowing the palm and thumb of the non-dominant hand to remain close to the blade to control short pieces of food while also leaving the remaining four fingers of the same hand in a position to press down evenly on the secondary handle. This includes those that require both hands to wrap around the handles as disclosed in patents: A. Haas U.S. Pat. No. 986,166 and Li Xiaoping Chinese Pat. No. CN2247586Y with vertical handle grips; Watermolen and Peters U.S. Pat. No. 5,920,992 with rising handles with finger grips; Wang Xiaobo Japanese Pat. No. JP11300058 and John Erikson U.S. Pat. No. 1,706,918 with a secondary handle built on the back top of a knife blade. W. L. Iwan U.S. Pat. No. 696,050 with handles fixed at right angles at the back of the blade.

Dexter-Russell (Product no. 09210) makes a double handle "cheese knife" with a conventional design handle on each end as well as a handle attachment (product no. 18000) for adding an additional handle to pizza knives. This attachment may conceivably be used to attach to a kitchen knife as well. Additionally, Carl. Carrillo U.S. Pat. No. 6,493,946 made a knife guard that can be applied to the top of a blade and used as an secondary handle. With these designs, the long axis of the secondary handle is parallel to the blade. A parallel arrangement (see FIG. 2C) is not ideally suited for the dual purpose of pinning down the front of the knife and assisting in the cut while also positioning the food item for the cut as there is a tendency for the index finger to exert significantly greater downward pressure than the other fingers and for other reasons as discussed in the primary operation of the main embodiment.

Barker and Barbour U.S. Pat. No. 230,393 developed a handle attachment that adds an additional handle to knives intended for cutting cheese. The handle design is very high profile and not suited for both assisting in the cutting and controlling of food items by the non-dominant hand. Furthermore, the long axis of the handle is perpendicular to the blade. A perpendicular arrangement (see FIG. 2D) is not ideally suited for the dual purpose of assisting in the cut while also controlling the food item as the fingers are unevenly placed on the handle creating unnecessary side torque as downward pressure is applied. The dominant hand would have to counteract this torque to keep the knife blade straight thus creating more stress on the wrists.

J. P. Smith U.S. Pat. No. 331,915 developed a knife having a conventional handle on one end and a high profile round handle extending off the top of a blade. The high profile handle makes it convenient for cutting high blocks of cheese but more difficult for the dual purpose of both cutting and controlling food items with the non-dominant hand. Furthermore, a round handle doesn't provide an ideal arrangement for the dual purpose of both positioning the food item and levering maximum downward pressure to cut it: because if a round handle was large enough to accommodate all four fingers of the non-dominant hand, over 3" diameter, the fingers would be mostly contacting the handle on one side of the knife blade thereby creating side torque as downward pressure is applied (see FIG. 2E).

Yet another limitation of the prior art is when the non-dominant hand is not required for controlling the food item or other object: now that the non-dominant hand and arm are free to assume a variety of positions to find the one most effective for the given situation, they are limited by the fixed position of the secondary handle itself. This is especially true with harder to cut items. Another limitation is that the presence of a secondary handle may limit the ease with which the knife may be sharpened and stored.

SUMMARY OF INVENTION

Objects and Advantages

Accordingly, several objects and advantages of the main embodiment of my invention are:

(a) to provide a double handle knife with a secondary handle which pivots to a position such that four fingers of the non-dominant hand may evenly press down on it while leaving the palm and thumb of the same hand in optimal position to control the food item being cut;

(b) to provide a double handle knife with a secondary handle which pivots thereby allowing versatility in the positions that the non-dominant hand and arm may assume for assisting in the cutting of food items especially in those situations in which the non-dominant hand is not needed for positioning the same;

(c) to provide means that rotating secondary handles of differing designs can be easily exchanged on the same knife thus further increasing its versatility;

(d) to provide means for easy secondary handle removal to facilitate one handed operation of the knife as well as making it easier for cleaning, sharpening and storage of the knife;

Further objects and advantages of additional embodiments are to provide:

(a) to provide rotating double handle knives with reversible means to detach the additional provisions necessary for attachment of the secondary handle thereby returning it to a single handle knife for situations where such provisions could interfere with storage or in the slicing of delicate bread and the like.

(b) to provide rotating secondary handle attachments that clamp to any single handle knife thereby converting it to a rotating double handle knife.

(c) to provide cheaper embodiments of a double handle knife and attachments that do not pivot but provide an optimal fixed-angle of a secondary handle for the non-dominant hand to both assist in the positioning of food items and the downward leverage necessary for cutting them.

Still further objects and advantages will become apparent from a consideration of the ensuing description and drawings.

BRIEF DESCRIPTION OF THE DRAWINGS

Note that the specification relating to the following embodiments should be construed as an exemplary rather than as a limitative of the present invention, with many variations and modifications being readily attainable by a person of average skill in the art without departing from the spirit or scope thereof.

DRAWINGS

List of Reference Numerals

Figure 1A:
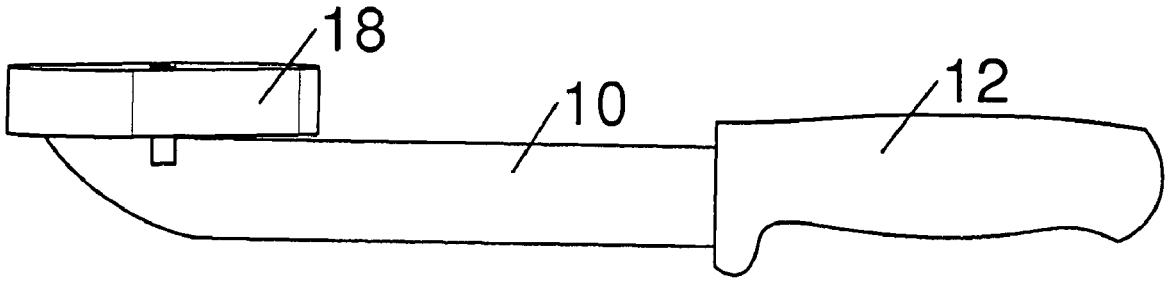
FIGS. 1A and 1B illustrate the basic components of the main embodiment of a rotating secondary handle knife design shown in fully assembled side elevation view of in FIG. 1A and shown in detail view of FIG. 1B.

10 blade
12 primary handle
14 pivot post
16 slot
18 secondary handle—simple version
20 hole
21 carrot food item
22 round handle
40 rotating secondary handle attachment
42 pivot post
44 clamping body
46 slot
48 Allen head set screw
50 blade
52 hole
56 lower mounting unit
58 slot
60 body
62 blind holes
64 pins
66 spring
70 end plate
72 release knob
74 connecting rods
80 secondary handle—bi-level version
82 lower section
84 hole
86 cross-member
88 upper section
90 secondary handle—crosswise-grip version
92 base
94 hole
96 bracket
98 handle grip
100 secondary handle—T-grip version
102 round handle grip
104 base
106 hole
108 thin connecting member
110 magnetic mounting unit
112 housing
114 slot
116 fixed flat bar magnet
118 floating flat bar magnet

120 backing plate
122 retracting rod
124 knob
126 side plate
130 fixed angle secondary handle
132 protruding lower section
134 transverse slot
140 fixed angle secondary handle attachment
142 handle press-pad
144 protruding lower mounting section
146 transverse slot

DETAILED DESCRIPTION

Figure 1B:
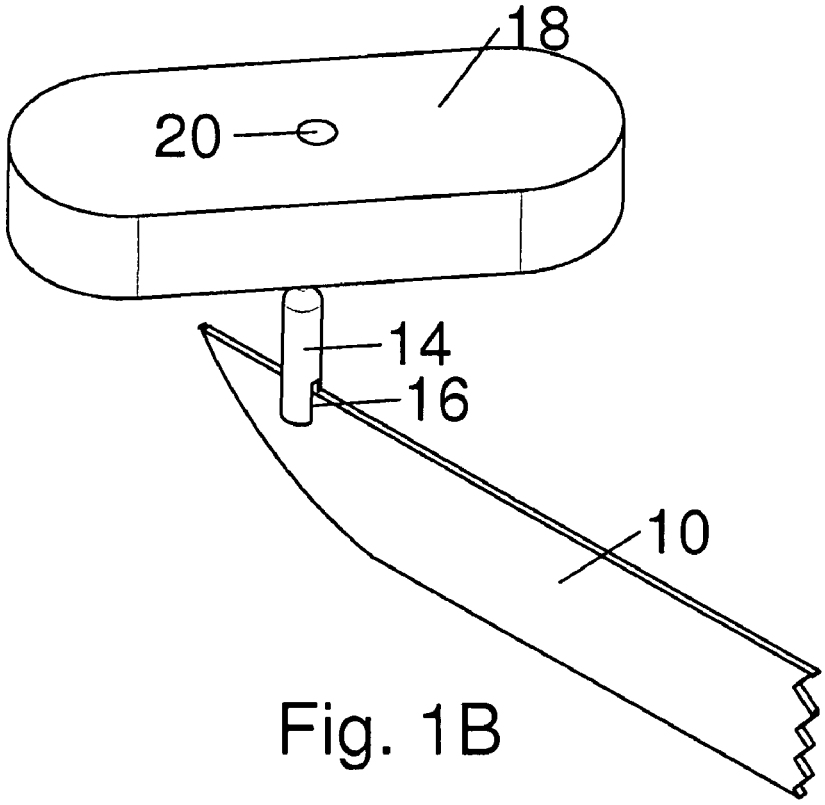

FIGS. 1A and 1B

Main Embodiment

The main embodiment of the present invention is illustrated in FIGS. 1A and 1B: fully assembled in side view in FIG. 1A and a front close up in FIG. 1B. At the back of blade 10 a primary handle 12 is fastened (FIG. 1A). Primary handle 12 may be of conventional design. A pivot post 14 (FIG. 1B) of stainless steel round bar is slotted 16 to fit over the top front of blade 10 and fastened by riveting or other permanent means. A simple version of secondary handle 18 has a length preferable greater than three inches to enable all four fingers (thumb excluded) of the non-dominant hand to press down on it and a width having sufficient surface for the fingers to comfortably press down on but preferably less than two inches as wider widths introduce unnecessary side load as discussed below for the primary operation of the main embodiment.

Secondary handle 18 may be wooden or plastic, smooth or with finger slots on top and has a centrally located hole 20 (FIG. 1B) of close tolerance to pivot post 14 to enable rotating on pivot post 14 when assembled. The secondary handle may rest on the blade and has a height sufficient to accommodate the pivot post as lower profiles facilitate the cutting method as described in the primary operation of the main embodiment. The pivot post arrangement allows ready removal of secondary handle for cleaning, storage and sharpening of the blade 10. Furthermore, the close tolerance prevents secondary handle 18 from slipping off when the present invention is turned upside down but may be retained by fasteners which allow the handle 14 to still rotate such as a spring loaded ball bearing built into post 14 and a corresponding groove in hole 20. Additionally, to lock the secondary handle to the pivot post 14 at a particular rotation if desired, secondary handle 18 may have a fastener such as a threaded hole with set screw intersecting hole 20. The secondary handle 18 may further carry a bearing or bushing insert with an inner diameter to match the pivot post outer diameter. The shape of the simple version embodiment of secondary handle 18 may be flattened rectangular, oblong, a piece of round bar, etc., and of various dimensions.

Furthermore, the pivot post may be mounted perpendicular to the long axis of blade 10, centered or parallel to a plane of the blade 10 as shown in FIGS. 1 A and B, thereby enabling pivoting of the secondary handle 18 in a plane above the top of the knife and at right angles to a plane of the blade. Alternatively, by mounting the pivot post at other angles, other planes of rotation may be achieved. As there are many means to attach the secondary handle 18 to the top of the blade 10 in a rotating fashion, the design presented above is not intended to limit the scope of the invention.

Primary Operation of the Main Embodiment

FIGS. 2A, 2B, 2C, 2D, and 2E

Figure 2A:
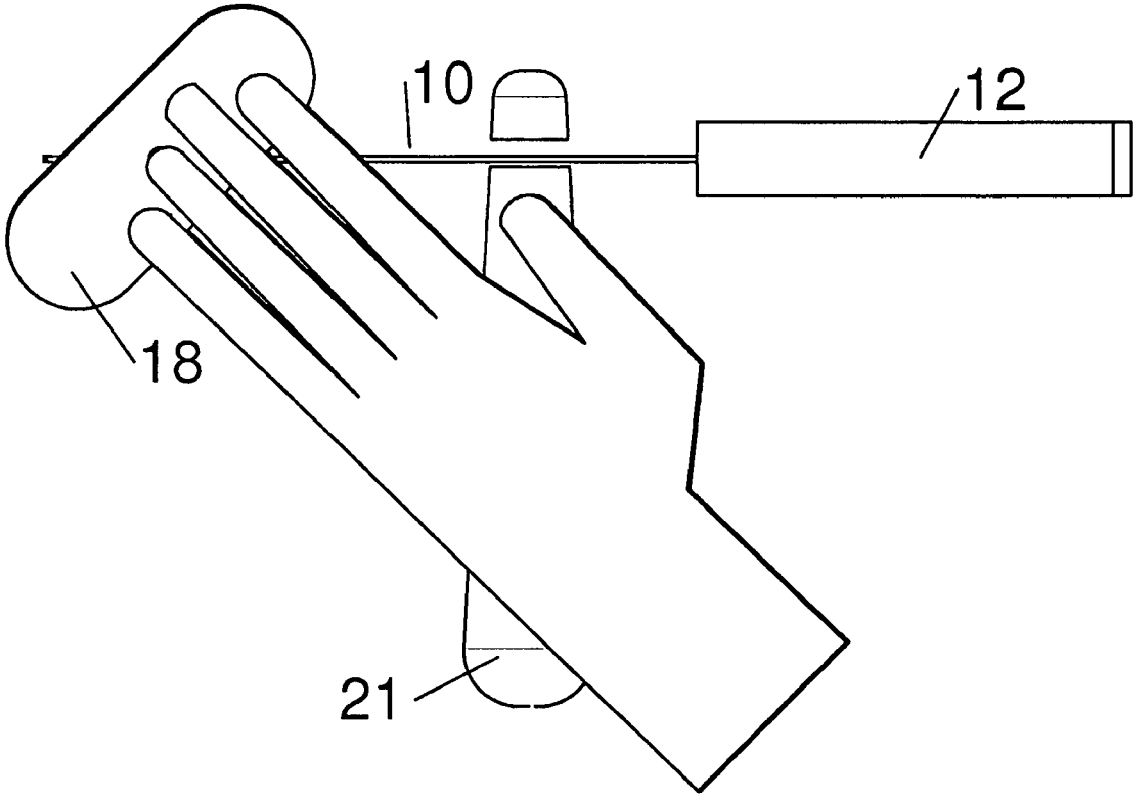
FIGS. 2A, 2B, 2C, 2D, and 2E are top plan views which illustrate the main embodiment of rotating double handle knife in use with the non-dominant hand on a secondary handle, controlling and assisting in the cutting of a food item as in FIG. 2A, depiction of the angle formed between secondary handle and blade as in FIG. 2B, and positions of a user's hand on the secondary handle controlling and cutting a food item in parallel position as in FIG. 2C, perpendicular position as in FIG. 2D, and on an alternative embodiment for a round handle as in FIG. 2E.
Figure 2B:
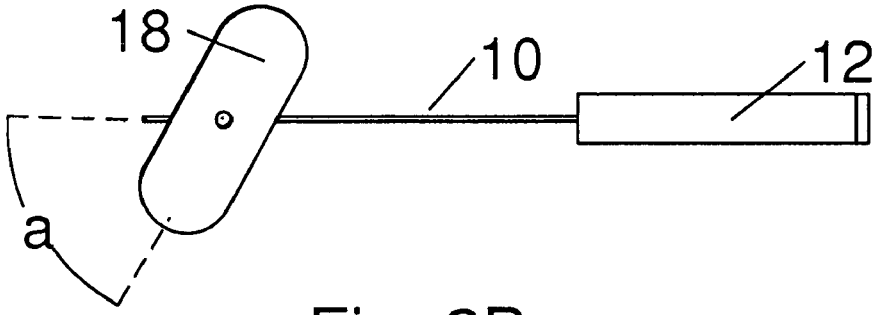

The operation of the main embodiment is illustrated in FIG. 2A (top view) showing the general positions of the user's non-dominant hand, secondary handle 18, object being cut (carrot 21 shown as example), knife blade 10, and primary handle 12. The palm and thumb of the non-dominant hand are kept close to blade 10 to position the object being cut whereas the four remaining fingers of the same hand press down on the secondary handle 18 pinning the front of blade 10 to the cutting surface. The dominant hand grips primary handle 12 in typical fashion raising it to clear over the food item being cut, then pressing down to initiate the cut as the fingers on secondary handle 18 continue to pin down the front of blade 10 and assist the dominant hand in cutting through the food item or other object. Secondary handle 18 can rotate 360 degrees. However, using this method of assisting with the cut and positioning food with the non-dominant hand the ideal angle (a) (FIG. 2B) formed between the long axis of secondary handle 18 to the long axis of blade 10 for a right handed person is 45 degrees (+ or −15 degrees). For a dominant left handed person the secondary handle 18 is simply rotated around and the corresponding angle on the other side of the blade is employed. This unique arrangement allows the fingers to be positioned evenly over both sides of blade 10 providing downward leverage with minimal side torque while still allowing the palm and thumb to be close to blade 10 to position even short food items. Furthermore, the fingertips instead of the base of the fingers can be used to apply even and balanced downward pressure on the secondary handle. This utilizes the full length of the non-dominant hand and therefore maximizes the flexibility thereof as the fingertips on the secondary handle rise when the back of the knife is raised to clear the food item while simultaneously having the palm and thumb pin down the food item.

Figure 2C:
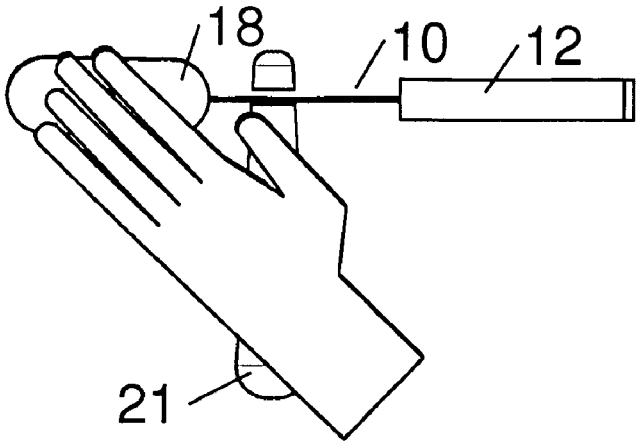

Other positions are less beneficial for using the cutting method described above. In double handle knives in which a secondary handle is mounted parallel to a blade, angle (a) is 0 degrees as shown in FIG. 2C. This position maximizes hand twisting as the index finger travels up and down more than the other fingers as the front of the knife remains pinned to the board and the back of the knife rises to clear the food item and then lowers to cut through it. Furthermore, the pinky finger has minimal or no contact with the secondary handle whereas the base of the index finger contacts the secondary handle causing the index finger to naturally exert significantly greater downward pressure than the other fingers. These factors increase the potential for hand and wrist strain.

Figure 2D:
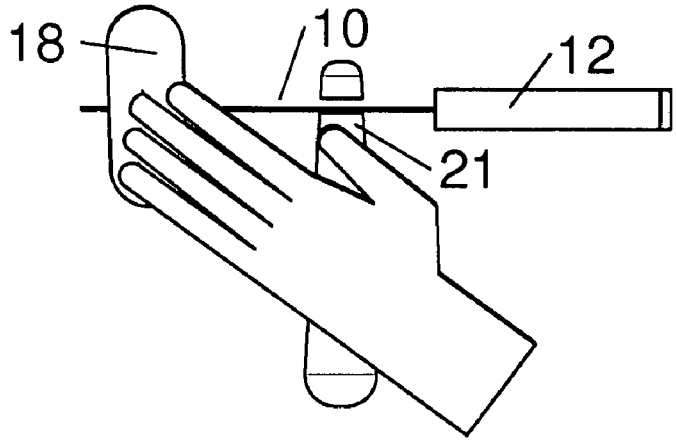
Figure 2E:
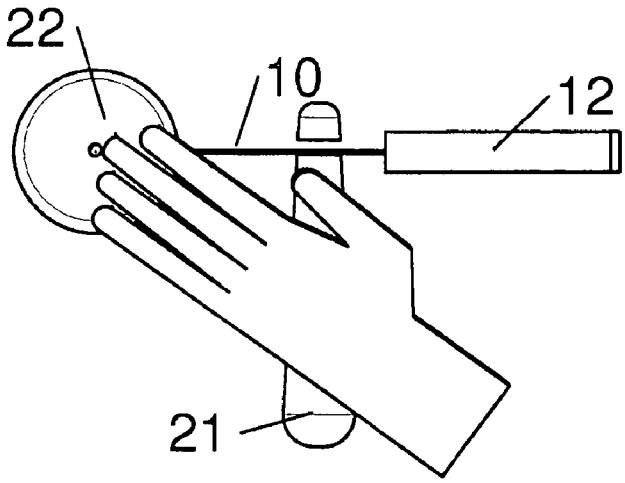

For a handle in a position perpendicular to the blade where angle (a) is 90 degrees as shown in FIG. 2D and for a round handle 22 able to accommodate four fingers as shown in FIG. 2E significant side torque is introduced because the fingers press down more on one side of the handle. This increases the likelihood for hand and wrist strain when cutting difficult objects.

Additional Operation and Advantages of Main Embodiment

The rotating double handle knife as described allows all angles of the secondary handle relative to the knife blade to be quickly assumed which can be a highly useful feature when the non-dominant hand is not required to control the object being cut. Pressing down firmly on the secondary handle with the non-dominant hand can be done with the handle rotated to the best position that a particular cutting chore warrants, thereby extending the range of positions possible and minimizing arm and wrist fatigue especially for repetitive chopping chores or cutting difficult items like frozen foods. Alternative handles designs can further enhance this function as shown in the operation and advantages illustrated in FIGS. 5A, 5B, and 5C.

Additional Embodiments

Operation and Advantages

Figure 3A:
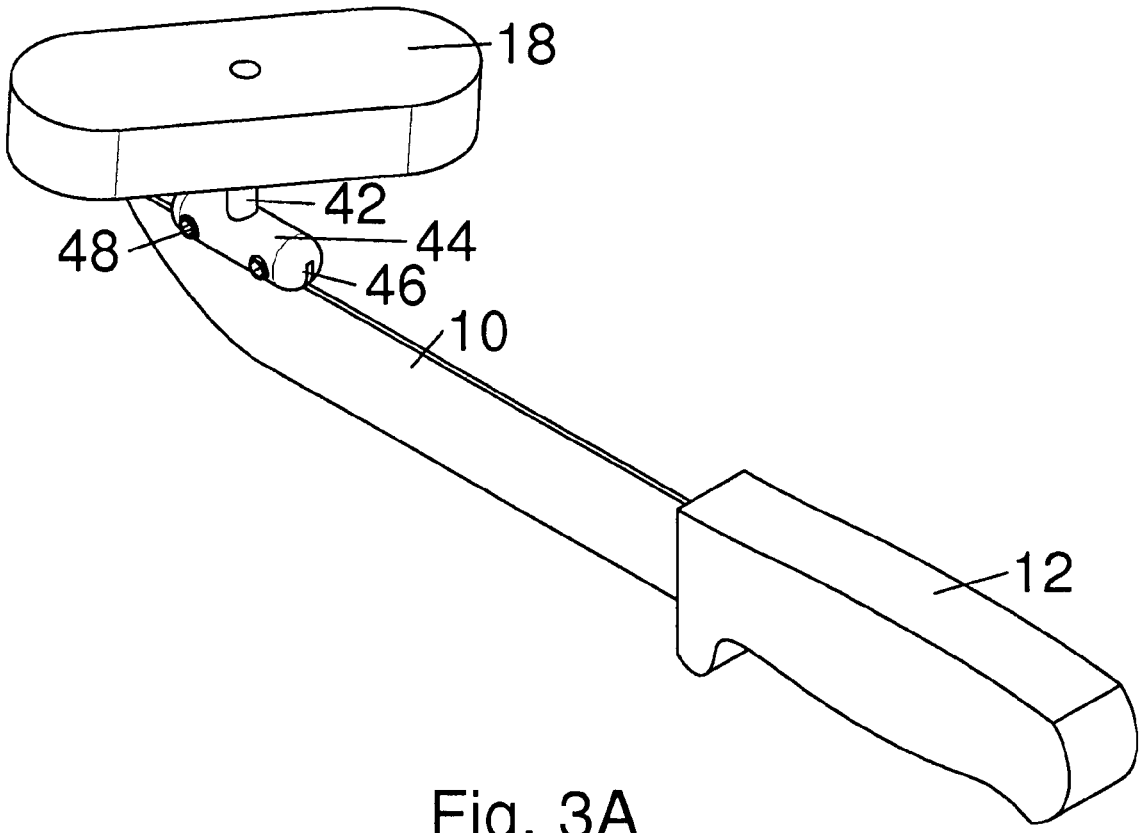
FIGS. 3A and 3B illustrate perspective views of a rotating double handle knife with a clamping body providing a reversible means to clamp the pivot post and secondary handle to the blade as in FIG. 3A and a rotating secondary handle attachment for conversion of a single handle knife into a rotating double handle knife as in FIG. 3B.
Figure 3B:
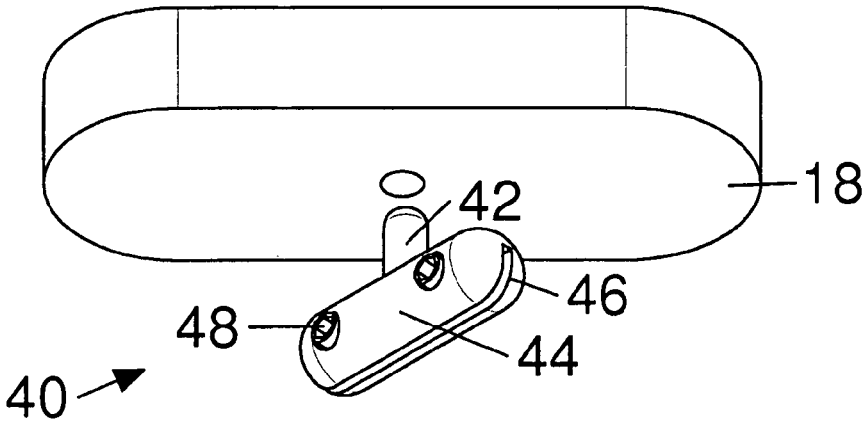

FIGS. 3A and 3B

FIG. 3A illustrates an embodiment of the double handle knife with reversible means to attach a pivot post 42 to blade 10. Pivot post 42 is affixed to a stainless steel clamping body 44 by solder or other permanent means. Clamping body 44 has a slot 46 which fits over blade 10 and fastened with Allen head set screws 48. Secondary handle 18 is fitted over pivot post 42 and functions essentially as in the main embodiment by enabling the secondary handle 18 to pivot 360 degrees in a plane. The reversible design has the advantage that the secondary handle 18 and pivot post 42 with clamping body 44 can be entirely removed, thereby converting the double handle knife into a conventional single handle knife for storage or for uses in which the pivot post might otherwise interfere with the cutting of an object.

FIG. 3B illustrates a rotating secondary handle attachment 40 comprising pivot post 42 attached to clamping body 44 and secondary handle 18 as per the double handle knife embodiment illustrated in FIG. 3A but without the blade and handle which provides the option for converting any single handle knife into a rotating double handle knife by inserting the top of a knife into slot 46 and tightening the Allen head screws 48.

Figure 5A:
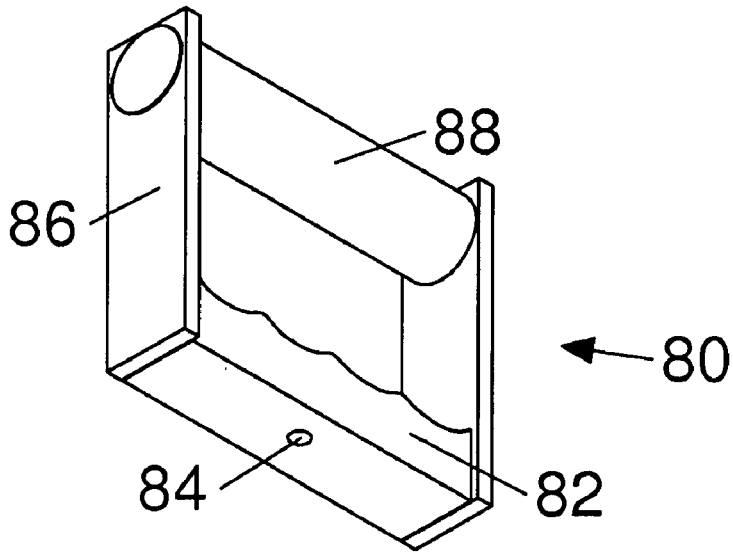
FIGS. 5A, 5B, and 5C illustrate additional embodiments of secondary handle design such as a bi-level version as in FIG. 5A, a crosswise-grip version as in FIG. 5B, and a T-grip version as in FIG. 5C.
Figure 5B:
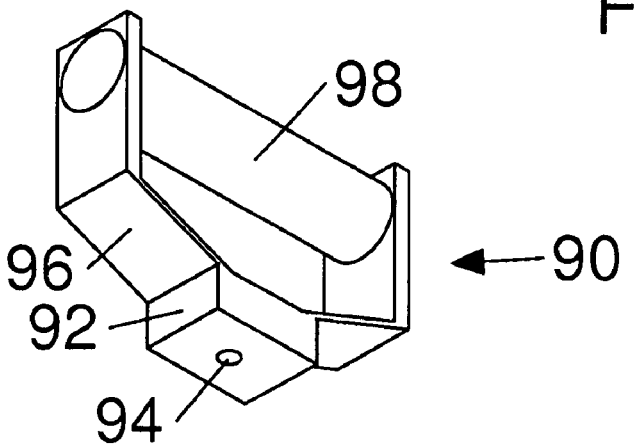
Figure 5C:
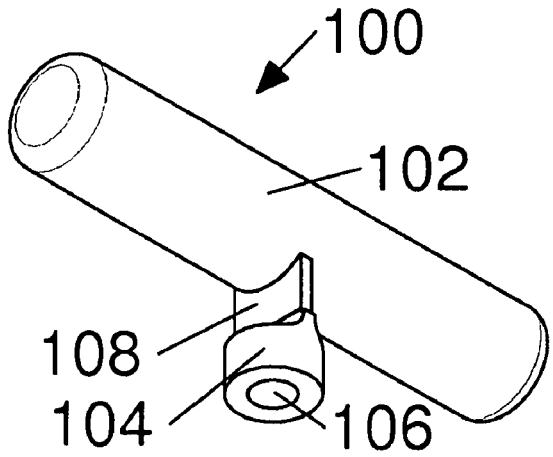

Other secondary handles designs such as those illustrated in FIGS. 5A, 5B, and 5C may be used with the clamping body and pivot post. Furthermore, there are many ways to design a pivot post that reversibly attaches to a knife blade. For example a pivot post may have a slot and setscrews in its bottom end in order to slide over a knife blade and be set in place directly without a separate clamping body 44. It is therefore noted that other modifications may be made to the present invention, without departing from the scope and spirit of the invention.

Additional Embodiments

Operation and Advantages

Figure 4A:
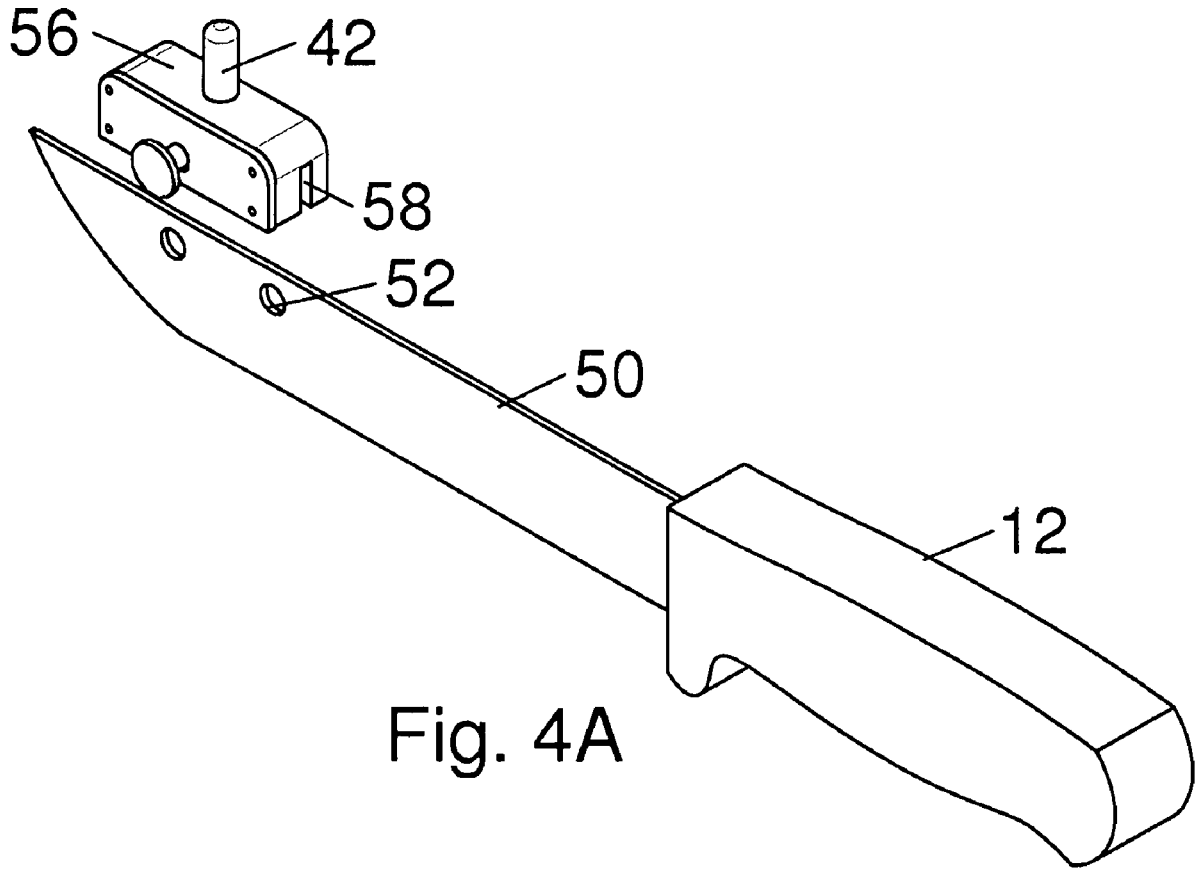
FIG. 4A is an exploded perspective view which illustrates a quick release mechanism to release the pivot post and modifications to the blade which facilitate the attachment and positioning of the quick release mechanism.
Figure 4B:
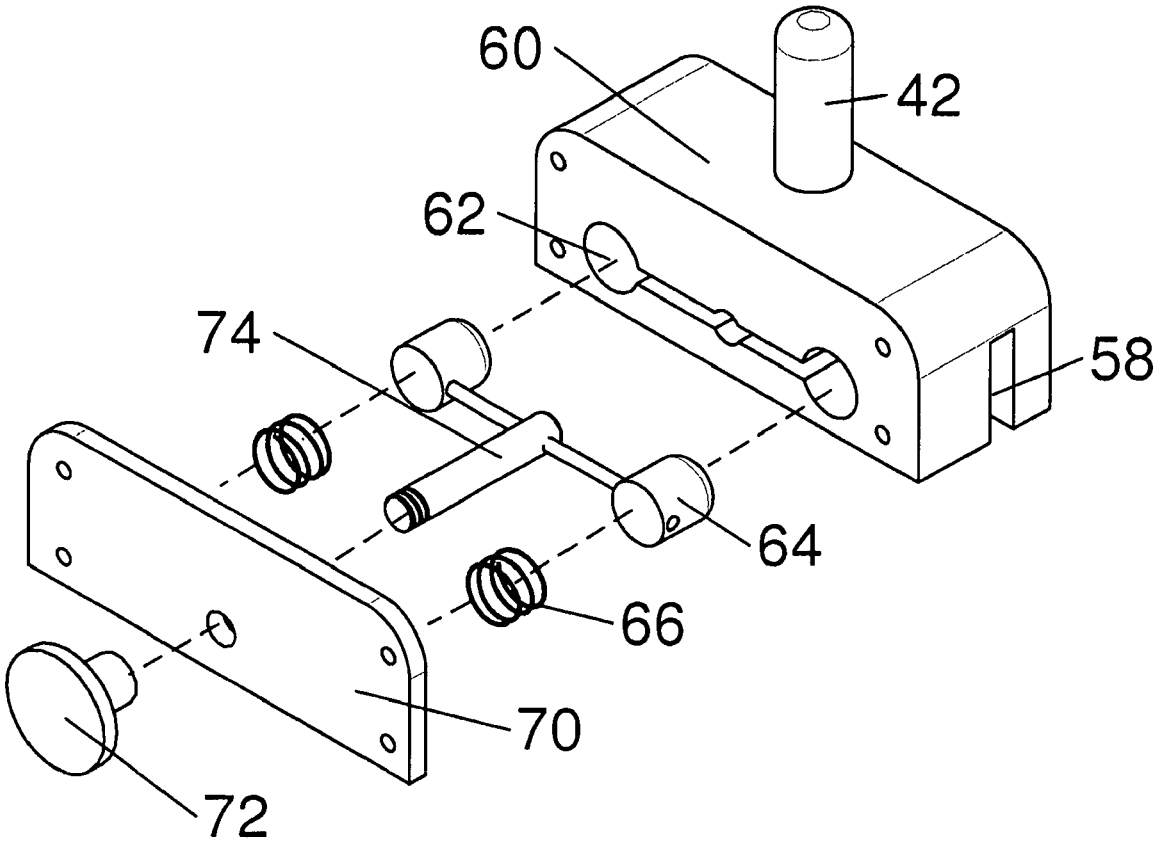
FIG. 4B is a close-up exploded detail perspective view of the quick release mechanism of FIG. 4A.

FIGS. 4A, 4B, and 4C

FIG. 4A illustrates a double handle knife embodiment with quick release means to attach a pivot post to a blade which utilizes a modification to the blade to help position and attach the pivot post. Blade 50 has two holes 52 and a primary handle 12 extending off the back end. A round bar pivot post 42 may be permanently attached to a lower mounting unit 56 by solder or other suitable means. Lower mounting unit 56 has a slot 58 to fit over the blade 50 and is aligned for attachment such that holes 52 in blade align with holes 62 in lower mounting unit (FIG. 4B), being locked together by two inserted pins 64 (FIG. 4B). FIG. 4B is an exploded view of the lower mounting unit with pivot post showing the body 60 having two blind holes 62 into which inserts two pins 64 which pass through slot 58 under spring 66 tension against end plate 70. Pulling on a release knob 72 pulls attached connecting rods 74 for engagement and disengagement of pins 64 with slot 58, thereby providing a quick attach and release mechanism to blade 50. Secondary handles such as those described in FIG. 1 and FIGS. 5A, 5B, and 5C may then be used to attach to the pivot post 54.

Additional Embodiments

Operation and Advantages

FIGS. 5A, 5B, and 5C

FIGS. 5A, 5B, and 5C illustrate examples of additional embodiments of the secondary handle that function with the various embodiments of the pivot post designs disclosed. These various embodiments may be made from molded plastic or other suitable means and have a hole 84, 94, or 106 or may have an inserted bushing or bearing to provide the hole to fit over the pivot post. Additionally, to facilitate the locking of the secondary handles to the pivot post at a particular rotation, these embodiments may have a fastener such as a threaded hole and set screw intersecting holes 84, 94, or 106. Fasteners may also be used to secure these handles to the pivot post such that they still pivot such as a washer screw threaded into the top of the pivot post. Furthermore the secondary handles have a length preferable greater than three inches to enable four fingers of the non-dominant hand to press down on it.

FIG. 5A illustrates a bi-level version of a secondary handle 80. Lower section 82 has a centrally located hole 84 and may function identical to the secondary handle 18 described in the primary operation of the main embodiment. The width of lower section 82 provides sufficient surface for the fingers to comfortably press down on but preferably less than two inches as wider widths introduce unnecessary side load as discussed for the primary operation of the main embodiment. To it, connected by two crossmembers 86 is an upper section 88 with a round hand grip enabling the non-dominant hand to wrap around for the application of downward pressure. The upper section 88 may be used when the non-dominant hand is not needed to control the food item being cut by providing even more versatility in the positions that the hands and arms may assume in cutting difficult objects such as frozen foods, pumpkins, etc. including a position in which the lower arm presses directly downward over the wrist with the non-dominant hand wrapped fully around the upper section 88 of the handle thus making fully available the power of the non-dominant arm and hand.

FIG. 5B illustrates a crosswise-grip version of the secondary handle 90 that provides the same feature and operation as the upper section in FIG. 3A but without the lower section feature. A base 92 with hole 94 to accommodate the pivot post has brackets 96 supporting round handle grip 98 upon which the non-dominant hand may wrap around.

FIG. 5C illustrates a T-grip version of the secondary handle 100 which comprises a base 104 with a hole 106 to accommodate a pivot post being connected to the round handle grip 102 by a connecting member 108 of thin cross section to pass with minimum discomfort between the middle and ring fingers when the fingers are used to wrap around the round handle grip.

Additional Embodiment

Operation and Advantages

Figure 6A:
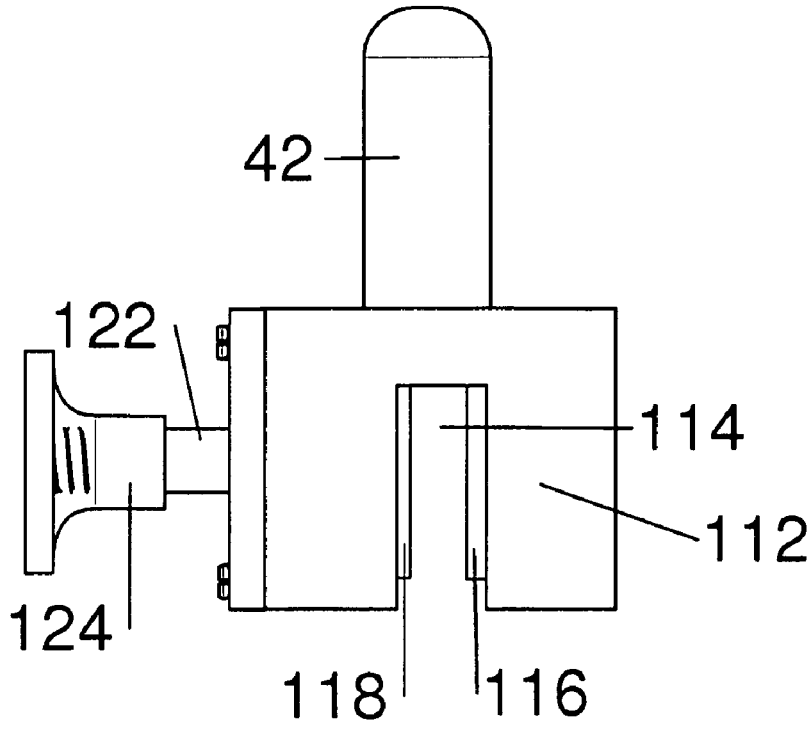
FIG. 6A is a side elevation view of an embodiment for a magnetic base mounting unit for the secondary handle.
Figure 6B:
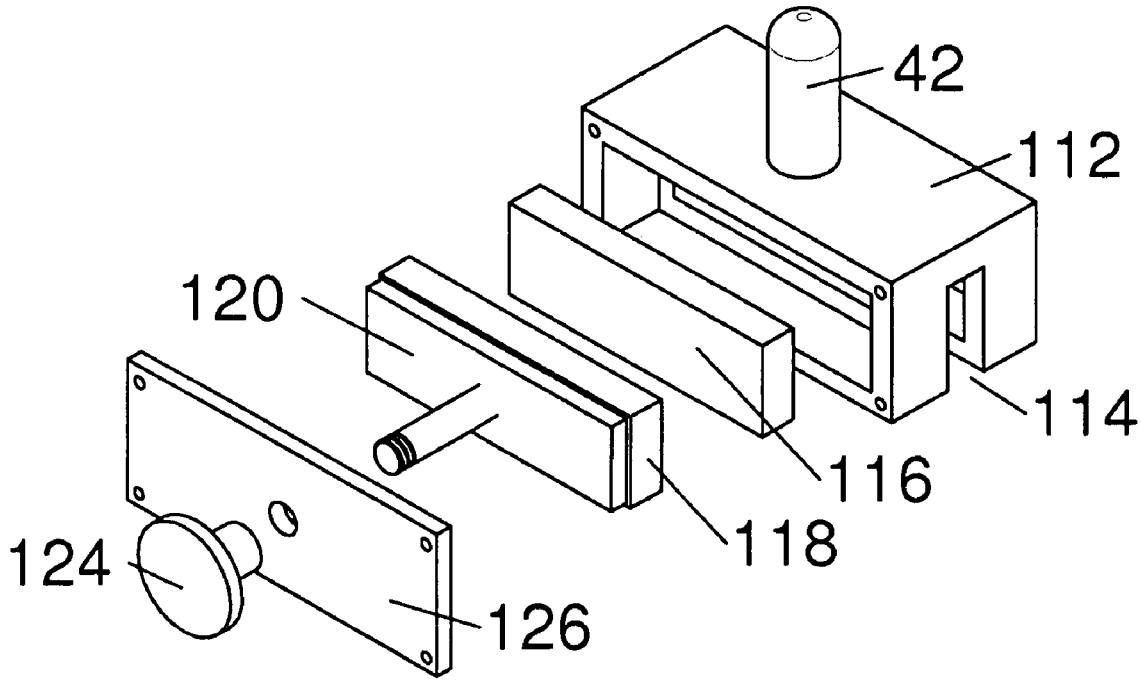
FIG. 6B is a exploded detail perspective view of magnetic base mounting unit of FIG. 6A.

FIGS. 6A and 6B

A pivot post may be attached to a blade by means of a mounting unit with pressure plates. Pressure can be exerted by, but not limited to, coil springs, leaf springs, resilient pads, rubberized grooves, and/or magnetic attraction. An embodiment utilizing magnet attraction to create pressure plate means of attachment is shown in FIGS. 6A and B in which the magnets are also the pressure plates.

FIG. 6A shows a side elevation view of a magnetic mounting unit 110 supporting pivot post 42. The housing 112 has a removable side plate 126 for assembly and slot 114 within which are a floating flat bar magnet 118 opposite a fixed flat bar magnet 116. The floating flat bar magnet 118 has attached backing plate 140, attached to retracting rod 122, attached to knob 124. Pulling back on knob 124 facilitates the quick release or attachment of knife blades between magnets 116 and 118.

FIG. 6B shows an exploded detail perspective view of the magnetic mounting unit 110 of FIG. 6A.

Magnetic mounting unit 110 mounts to any knife without tools or modifications and can accommodate a variety of thicknesses due to the floating nature of magnet 118. Furthermore, it mounts to even stainless steel (with low magnetic attraction) or even non-metallic ceramic blades, since the two magnets 116 and 118 attract each other. Magnets 116 and 118 can be any appropriate magnetic material, such as, for example, but limited to, neodymium magnets or ceramic magnets. Thus, a magnetic mounting unit 110 as described together with a secondary handle 10, 80, 90, 100, blade 10, and primary handle 12 provides a pivoting double handle knife, or together with the secondary handle alone, provides a pivoting secondary handle attachment to convert any single handle knife into a pivoting double handle knife.

Additional Embodiments

Operation and Advantages

Figure 7A:
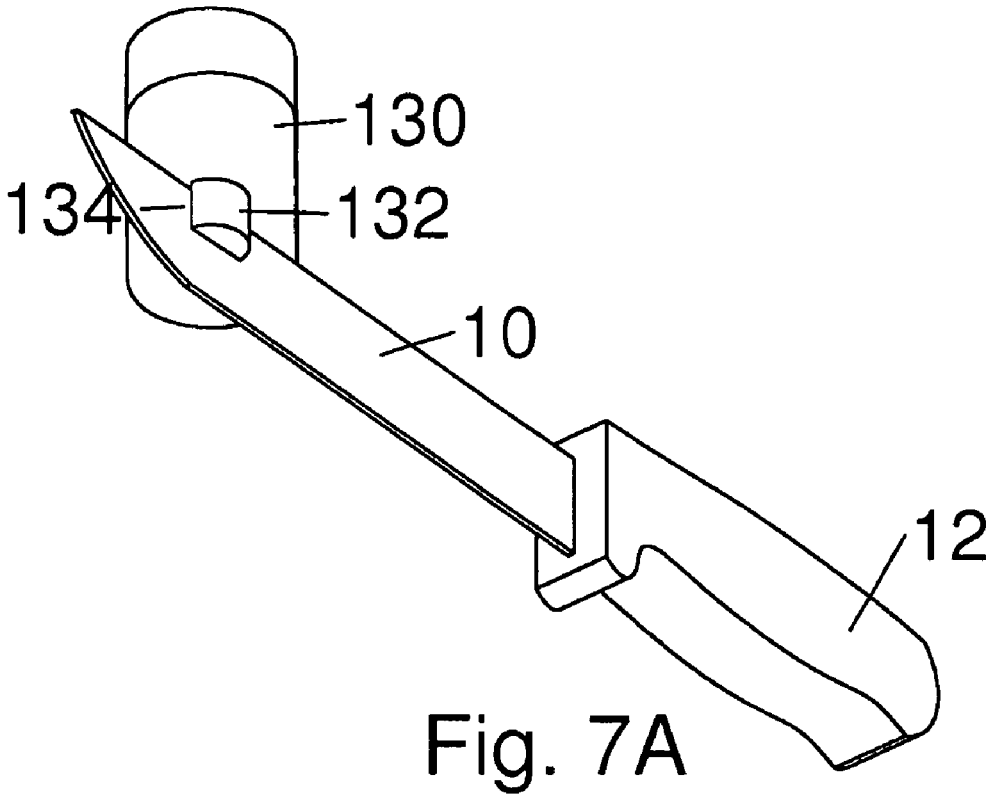
FIGS. 7A and 7B illustrate embodiments of fixed angle secondary handle designs such as a double handle knife with fixed angle secondary handle as in FIG. 7A and a fixed angle secondary handle attachment as in FIG. 7B.
Figure 7B:
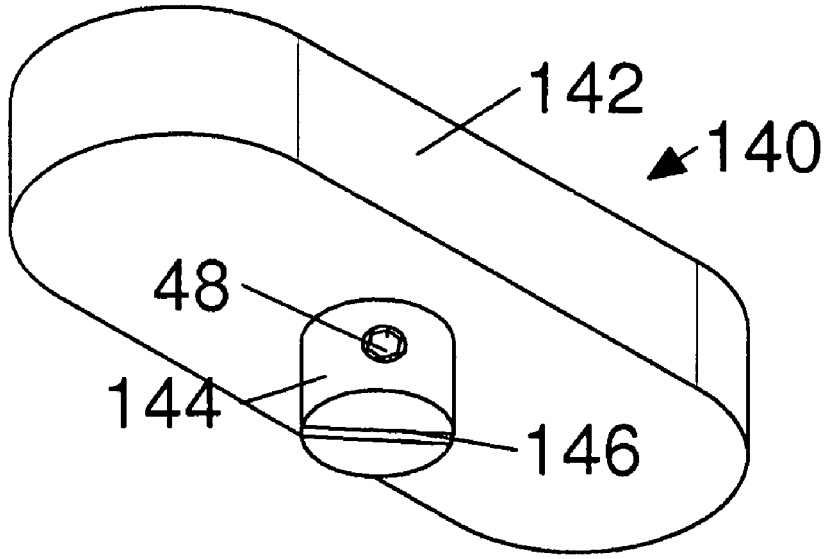

FIGS. 7A and 7B

The fixed angle secondary handles discussed and as illustrated in FIG. 7 may be made of molded plastic and have a length preferable greater than three inches to enable all four fingers (thumb excluded) of the non-dominant hand to press down on it and a width having sufficient surface for the fingers to comfortably press down on but preferably less than two inches as wider widths introduce unnecessary side load as discussed for the primary operation of the main embodiment.

FIG. 7A illustrates a double handle knife with a primary handle 12 extending off the back of the blade 10. The fixed angle secondary handle 130 may have a protruding lower section 132 with a transverse slot 134 fitted over the blade and may be permanently attached thereof with rivets. The angle of the slot 136 is such that it will position the fixed angle secondary handle 130 at an angle (a) (see FIG. 2B) of 45 degrees (+ or −15 degrees) to the blade 10 thereby providing an optimal angle for the cutting method described for the primary operation of the main embodiment.

The fixed angle secondary handle 130 is without the rotating advantage of the main embodiment which limits the overall positions that the hands and arms can assume in finding the most effective position in situations where the secondary hand is not needed to control the food item during the cut. However, a potential advantage is that it may be cheaper to manufacture while still allowing the cutting method described for the primary operation of the main embodiment.

An alternative version of the double handle knife embodiment illustrated in FIG. 7A comprises a blade 10 providing a fixed angle secondary handle 130 with reversible means to attach to blade 10. The fixed angle secondary handle design and means of attachment is essentially identical to the fixed angle secondary handle attachment 140 illustrated in FIG. 7B.

FIG. 7B illustrates a fixed angle secondary handle attachment 140 that attaches to any knife but does not pivot. A handle press-pad 142 may have a protruding lower mounting section 144 with a slot 146 transverse to the long axis of the handle which slips over a knife blade to be locked in place with a Allen head set screw 48. The angle of the transverse slot 146 is such that it will position the fixed angle secondary handle attachment 140 at an angle (a) (see FIG. 2B) of 45 degrees (+ or −15 degrees) to the blade to which it attaches thereby converting a single handle knife into a double handle knife with an optimal angle of secondary handle for the cutting method described for the primary operation of the main embodiment.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

I claim:

1. A knife comprising:

a blade having a bottom cutting edge and a top edge;

a primary handle extending from a rear end of the blade and a secondary handle;

a means for rotatably mounting said secondary handle on said top edge of the blade;

said secondary handle having a longitudinal axis sufficiently wide to accommodate multiple fingers thereby allowing the fingers to press down with minimal side torque and a means for receiving said means for rotatably mounting substantially centered on said longitudinal axis; and said secondary handle being rotatable within a plane located above the top edge of said blade and said plane being substantially perpendicular to a plane defined by the top edge and the bottom cutting edge of the blade.

2. The knife of claim 1 wherein said means for rotatably mounting said secondary handle comprises a pivot post mounted to the top edge of said blade, said means for receiving said means for rotatably mounting is an aperture in said secondary handle, and wherein said aperture receives said pivot post thereby allowing said secondary handle to rotate.

3. The knife of claim 2 wherein the pivot post is permanently attached to the top edge of said blade.

4. The knife of claim 1 wherein the means for rotatably mounting said secondary handle is reversible and comprises a pivot post.

5. The knife of claim 4 wherein the means for rotatably mounting said secondary handle further comprises a clamping body attached to the pivot post, said clamping body having a tightening screw extending through a side portion to secure the clamping body to the blade and a slotted bottom portion to fit on the top edge of the blade.

6. The knife of claim 4 wherein the means for rotatably mounting said secondary handle further comprises a lower mounting unit with a means for attaching connected to the pivot post, the blade has a means for accepting, and wherein cooperation between the means for accepting of the blade and the means for attaching of the mounting unit allow the lower mounting unit and the pivot post to be attached to the top edge of the blade.

7. The knife of claim 6 wherein the means for accepting is two holes in the blade.

8. The knife of claim 6 wherein the means for attaching is spring loaded pins with a quick release knob.

9. The knife of claim 4 wherein the means for rotatably mounting said secondary handle further comprises a mounting unit attached to the pivot post, said mounting unit having a means for applying and retracting pressure thereby allowing for the mounting unit and the pivot post to be quickly released from the blade.

10. The knife of claim 9 wherein the mounting unit further comprises a slot engageable with the top edge of the blade, said slot further comprising a fixed flat bar magnet and a floating bar magnet that is in communication with the means for applying and retracting pressure.

11. The knife of claim 1 wherein the secondary handle is selected from a group consisting of a simple handle, a dual function handle, a cross-grip handle, and a T-grip handle.

* * * * *